US005567077A

United States Patent [19]

Yang

[11] Patent Number: 5,567,077

[45] Date of Patent: Oct. 22, 1996

[54] DRAINAGE NETWORK

[76] Inventor: Jesse S. Yang, No 1, Lane 36, Avenue 357, Sec 2, Nan-Shan Rd., Lu-Jwu Shiang, Taur Yuan Hsien, Taiwan

[21] Appl. No.: 198,021

[22] Filed: Feb. 17, 1994

[51] Int. Cl.[6] ..... E02B 11/00

[52] U.S. Cl. ..... 405/45; 52/169.5; 405/36; 405/43

[58] Field of Search ..... 405/43, 45, 36–42, 405/46–51; 52/169.5, 169.14

[56] References Cited

U.S. PATENT DOCUMENTS

| | | | |
|---|---|---|---|
| 901,582 | 10/1908 | Austin | 405/43 |
| 1,687,782 | 10/1928 | Norton | 405/43 X |
| 3,965,686 | 6/1976 | Saito et al. | 405/43 |
| 4,061,272 | 12/1977 | Winston | 405/45 |
| 4,140,421 | 2/1979 | Llyod | 405/43 |
| 4,168,335 | 9/1979 | Vos et al. | 405/16 X |
| 4,309,855 | 1/1982 | Pate et al. | 52/169.5 |
| 4,328,640 | 5/1982 | ReVelle | 405/45 X |
| 4,538,387 | 9/1985 | Barnett et al. | 52/169.5 |
| 4,760,674 | 8/1988 | Brand et al. | 52/169.5 |
| 5,002,427 | 3/1991 | Kambe et al. | 405/50 X |
| 5,056,281 | 10/1991 | McCarthy | 405/45 X |

*Primary Examiner*—Dennis L. Taylor
*Attorney, Agent, or Firm*—Pro-Techtor International

[57] ABSTRACT

The present invention concerns a drainage network, which is characterized by the fact that said drainage network is a network for ground constructions equipped with drainage belts with which a three-dimensional drainage network system for diverting water can be formed in the ground, thereby providing rain water and underground water accumulated in the ground a means to be drained for the purposes of alleviating hydraulic pressure exerted on the ground, increasing ground stability and preventing earth movements from occurring in the construction site.

3 Claims, 7 Drawing Sheets

DRAINAGE NETWORK

BACKGROUND OF THE INVENTION

The present invention concerns a drainage network for construction sites. The network includes drainage belts which form a three-dimensional drainage network system for diverting water in the ground. Rain water and underground water accumulated in the ground are drained for the purposes of alleviating hydraulic pressure exerted on the ground, increasing ground stability and preventing earth movements from occurring in the construction site.

The material used for the network is a synthetic polymeric material. Said synthetic network material can be formed by elongating thin strips of a polymeric material with a prestressing machine as shown in FIG. 1, or it can be fabricated with high tensile-strength polyester fiber bundles wrapped with a polyethylene layer as shown in FIGS. 2 and 3. The drainage network for construction sites forms a binding structure for the earth under the site, preventing the deformation of the ground and inhibiting earth movements from occurring in the construction site.

When conventional drainage networks are used, the resulting drainage configuration formed between the drainage network and the ground very often causes serious adverse effects on the ground system in terms of ground pressure, ground stability and earth movements in the construction site.

The conventional drainage systems installed in construction sites are also directed to allowing rain water and underground water accumulated in the ground to be drained for the purposes of alleviating hydraulic pressure exerted on the ground, increasing ground stability and preventing earth movements from occurring in the construction site. Conventional systems typically involve the employment of underground drainage devices (e.g., the French drainage pipe shown in FIG. 4) at the bottom of said system, so that water can be effectively drained from the ground system.

In order to control costs, the drainage pipes installed in the ground system are typically three to four meters apart. Conventional systems are not optimal in that the process of installing these pipes is tedious and water cannot be effectively removed via these pipes because of the separating distance. The end result is that the ground at the site is muddy and the ground water pressure builds up quickly, resulting in pivotal earth shifting in the construction site.

In light of the aforementioned problems, the present invention offers a drainage network in which each strip of the network is equipped with one or more drainage belts placed in the soil to form a three-dimensional drainage network system for quickly draining the rain water and underground water accumulated in the ground, thereby alleviating hydraulic pressure exerted on the ground, increasing ground stability and preventing earth movements from occurring in the construction site.

The drainage network pertaining to the present invention is comprised of a multiple number of drainage strips in a network configuration in which each drainage strip includes a strip, one or more sets of high tensile-strength fiber bundles and one or more drainage belts. One or more sets of said high tensile-strength fiber bundles are embedded in a polymeric material (e.g., polyethylene or another appropriate polymer) using a molding device, thereby forming a strip embedded with one or more sets of high tensile-strength fiber bundles. The center, one side or both sides of said strip are equipped with a slot, and one or more drainage belts are inserted into each of the slots on said strip with a machine, thereby forming said drainage strip.

The principal objective of the present invention is to offer a drainage network with which an effective three-dimensional drainage network system can be established in ground structures.

Another objective of the present invention is to offer a drainage network that can be installed efficiently for replacing typical conventional piping systems (e.g., French pipe) with which rain water and underground water can be drained completely and instantly.

DETAILED DESCRIPTION OF THE PREFERRED EMBODIMENTS

Practical Example 1

Figure 1:
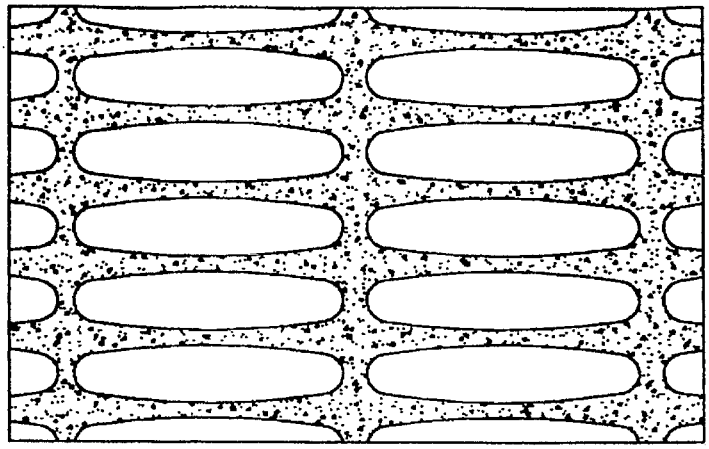
FIG. 1: A drawing showing a material for a drainage network formed by elongating thin strips of a polymeric material.
Figure 5:
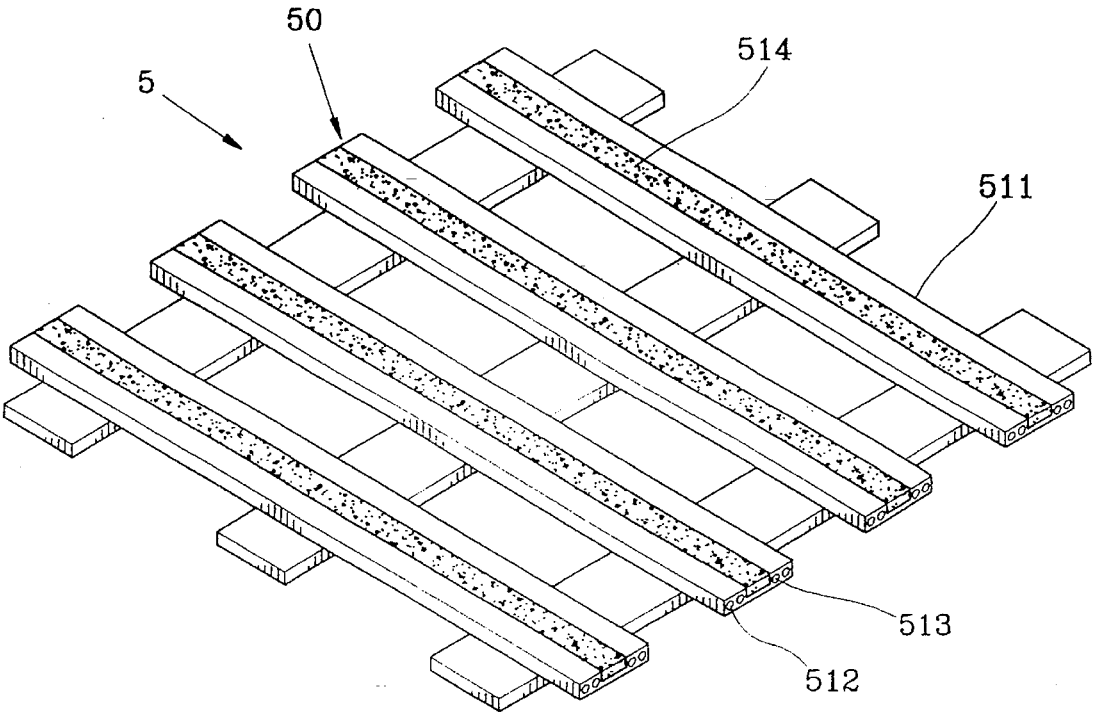
FIG. 5: A three-dimensional drawing of the drainage network pertaining to Practical Example 1 of the present invention.
Figure 5A:
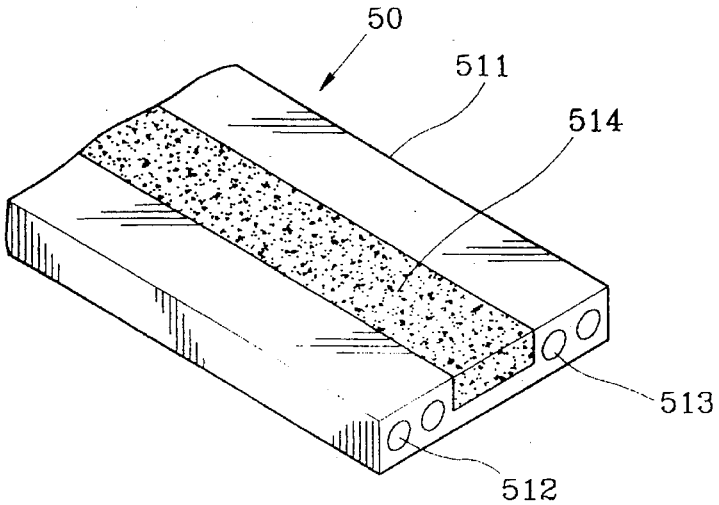
FIG. 5A: A three-dimensional drawing of the drainage strip of the drainage network pertaining to Practical Example 1 of the present invention.
Figure 6:
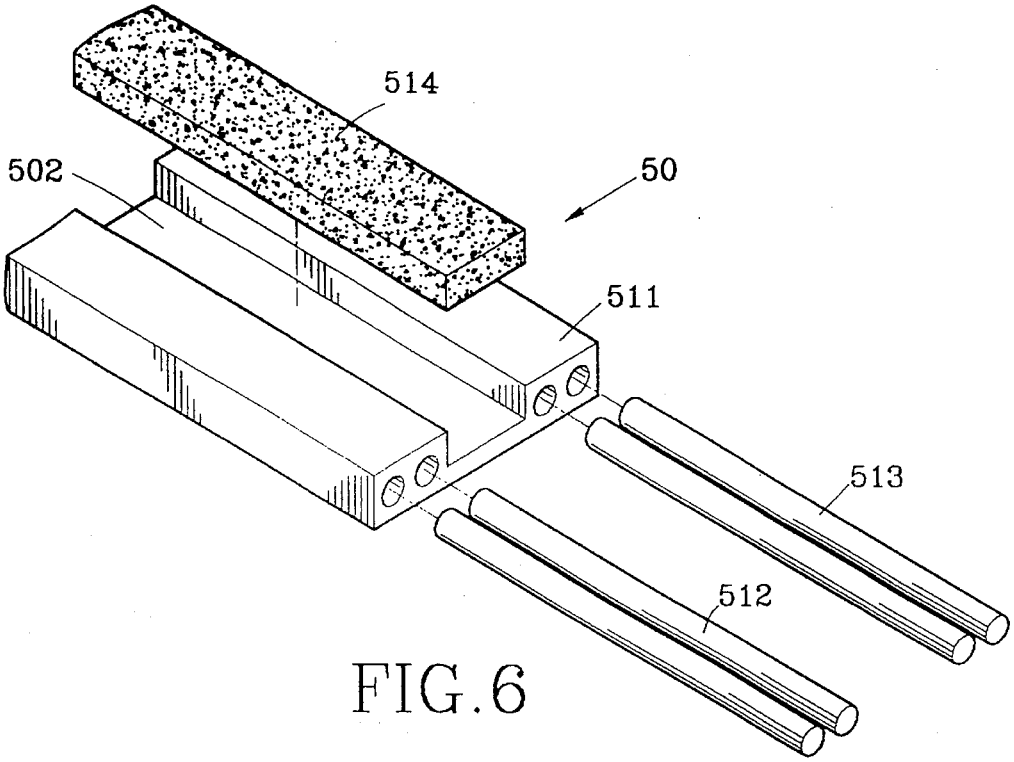
FIG. 6: An exploded view of the drainage strip of the drainage network pertaining to Practical Example 1 of the present invention.
Figure 6A:
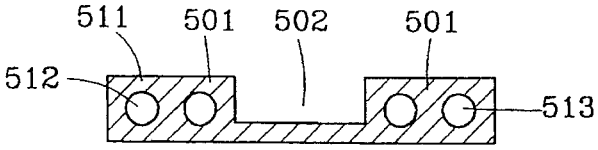
FIG. 6A: A cross-sectional view of the notched strip of the drainage strip shown in FIG. 6.
Figure 6B:
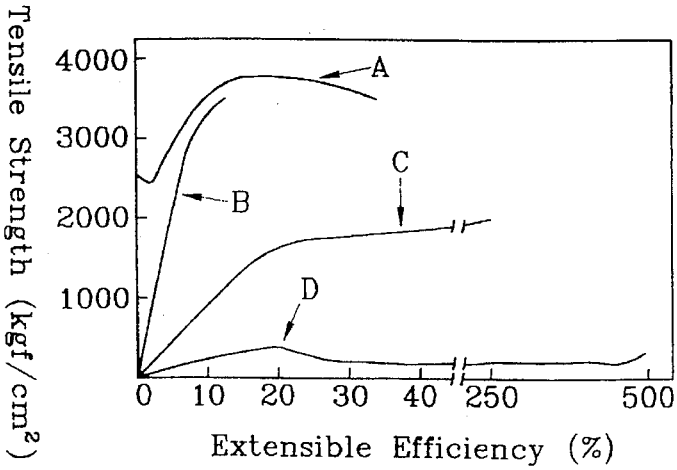
FIG. 6B: A graph showing the relationships between elongation and tensile strength of several notched strips made of different materials, wherein A is soft steel, B is the present drainage network, C is unwoven cloth and D is a resin drainage network.
Figure 7:
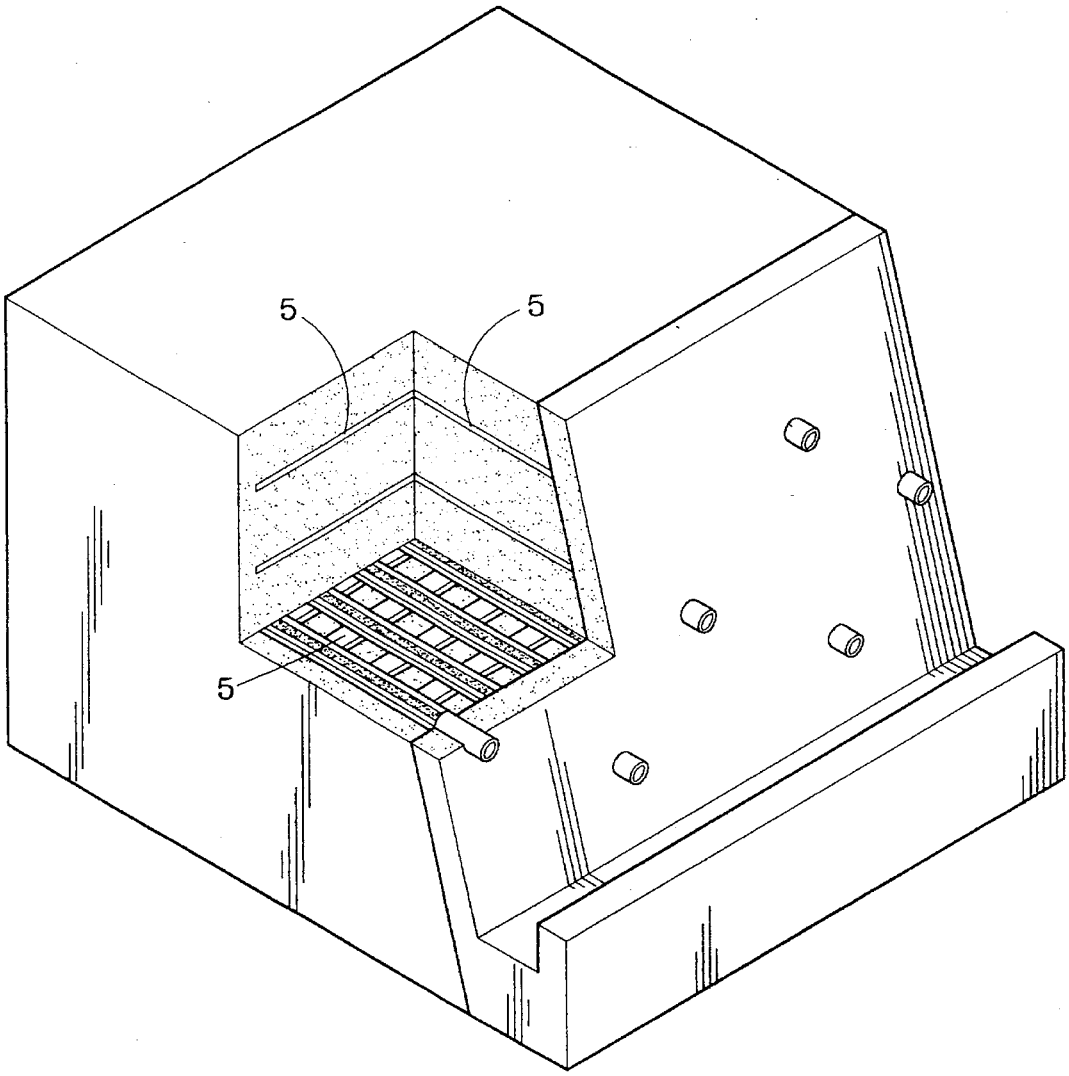
FIG. 7: A drawing showing the application of the drainage network pertaining to Practical Example 1 of the present invention in a retaining wall.

As shown in FIG. 5, the drainage network 5 pertaining to the present invention comprises a plurality of drainage strips 50 in a network configuration. As shown in FIGS. 6 and 7, said drainage strip 50 possesses a notched strip 511, two sets of high tensile-strength polyester fiber bundles 512 and 513, and a drainage belt 514. A slot-containing strip 501 including two sets of high tensile-strength polyester fiber bundles 512 and 513 is embedded in said notched strip 511 as shown in FIG. 6-1. The strip 501 is formed by molding using a molding device in which the two sets of high tensile-strength polyester fiber bundles 512 and 513 separated by an appropriate distance are embedded in a polyethylene material. The center of said slot-containing strip 501 is equipped with a slot 502. A drainage belt 514 is inserted into said slot 502 in the center of said slot-containing strip 501 with a machine, thereby forming said drainage strip 50.

Figure 2:
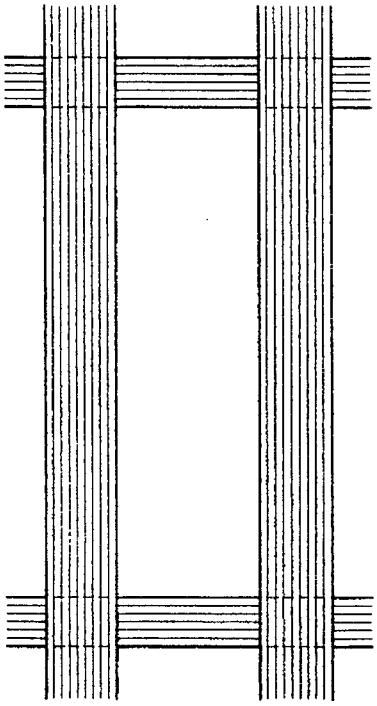
FIG. 2: An upper view of a material for a drainage network fabricated with high tensile-strength polyester fiber bundles wrapped with a polyethylene layer.
Figure 3:
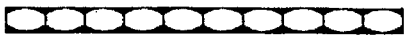
FIG. 3: A cross-sectional drawing of the network material described in FIG. 2.
Figure 4:
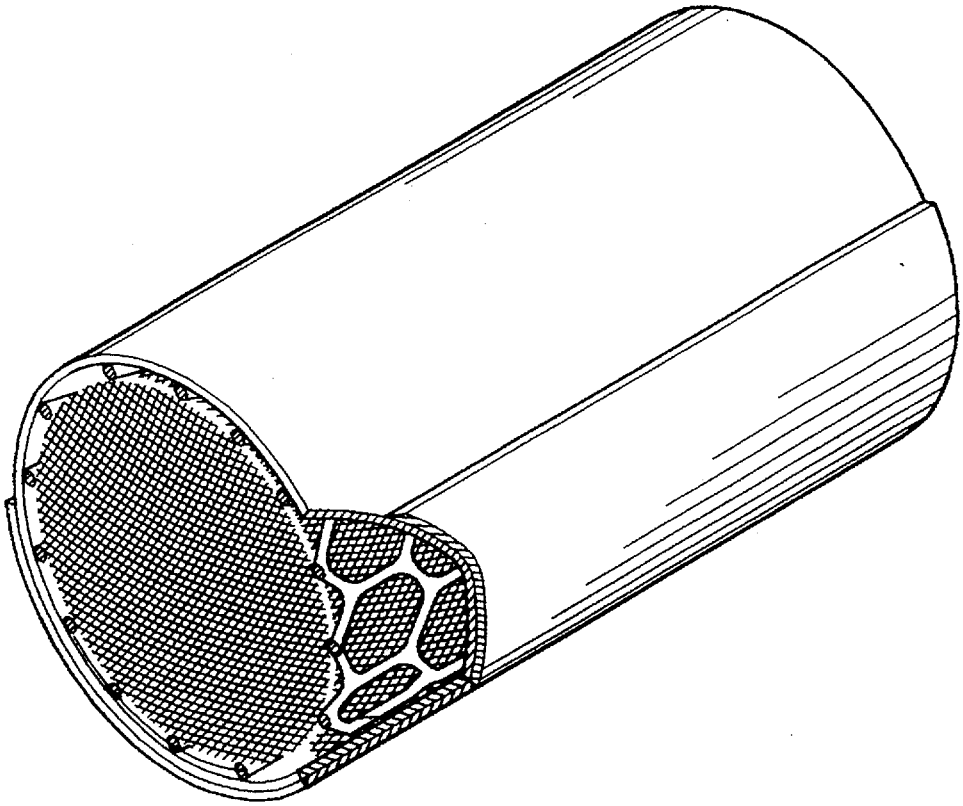
FIG. 4 (PRIOR ART)
FIG. 4: A three-dimensional drawing of a conventional French drainage pipe.

A polyethylene material is used to form the strip 511. Two sets of high tensile-strength polyester fiber bundles 512 and 513 are embedded in the strip 511 and are separated by an appropriate distance to form two slot-containing strips 501. The high tensile-strength polyester fiber bundles 512 and 513 inside said slot-containing strip 501 possess many very desirable properties, such as durability, UV resistance, chemical resistance, bio-resistance and tensile strength. As shown in FIG. 6-2, the fiber material forming the bundles 512 and 513 possesses a tensile strength not less than that of soft steel when elongated below approximately 20%. The function of the polyethylene notched strip 511 is to maintain the shape of said slot-containing strips 501 and to prevent said high tensile-strength polyester fiber bundles 512 and 513 from being damaged during installation. The drainage belt 514 inside the slot 502 at the center of said slot-containing strip 501 provides the means for rain water and underground water to be drained from a site equipped with said drainage network of the present invention.

The drainage network 5 of the present invention possesses the following advantages.

1. The present device includes a network configuration, with which said drainage network pertaining to the present invention can interlock with the ground to form a unitary system. Additionally, forces exerted on the ground can be transferred readily to and be absorbed by the drainage network equipped with high tensile-strength fiber bundles.

2. Conventional high tensile-strength materials are designed to separate the ground into layers. Such a configuration is undesirable in that water and air are retained in the earth below the high tensile-strength material. As a result, not only is the earth not strengthened, the safety of the entire ground system is also jeopardized. When the present device is employed, the continuity of the ground is not interrupted Accordingly, the problems described above do not occur.

Practical Example 2

Figure 8:
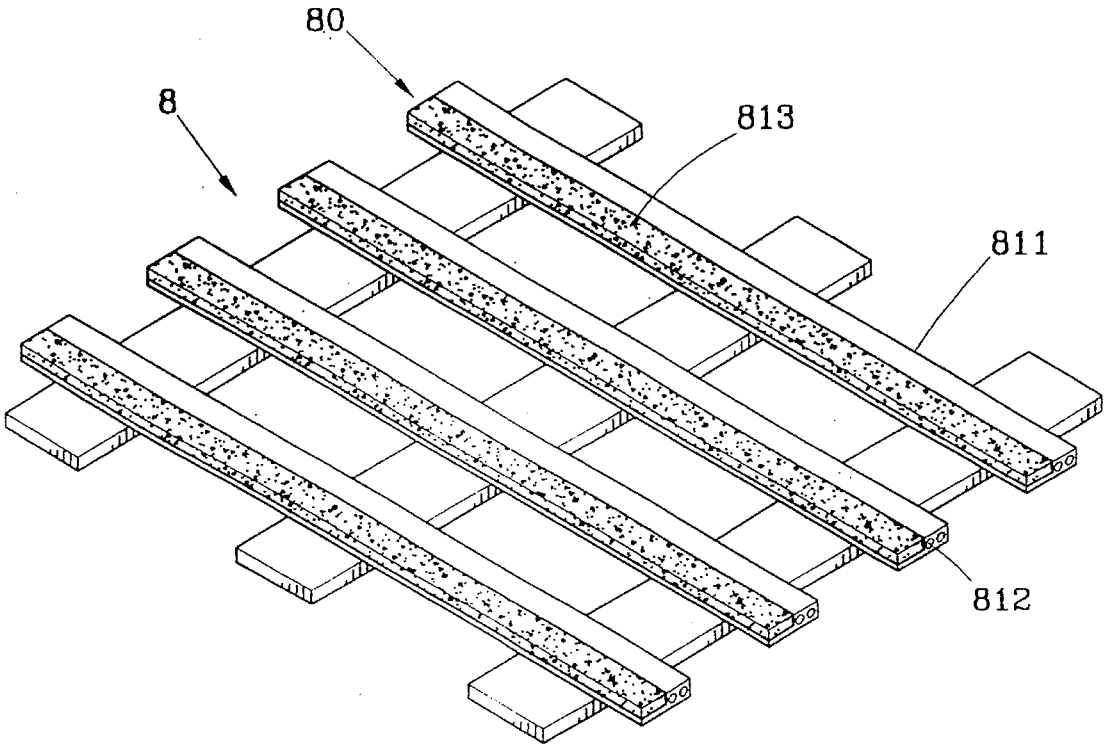
FIG. 8: A three-dimensional drawing of the drainage strip of the drainage network pertaining to Practical Example 2 of the present invention.
Figure 8A:
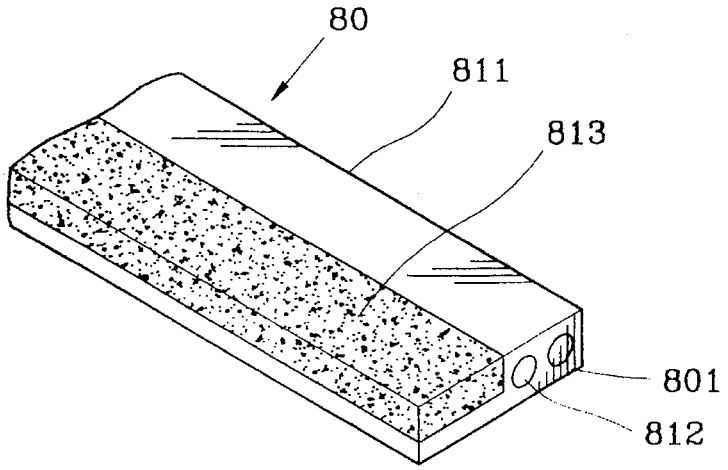
FIG. 8A: A three-dimensional drawing of the drainage strip of the drainage network pertaining to Practical Example 2 of the present invention.
Figure 9:
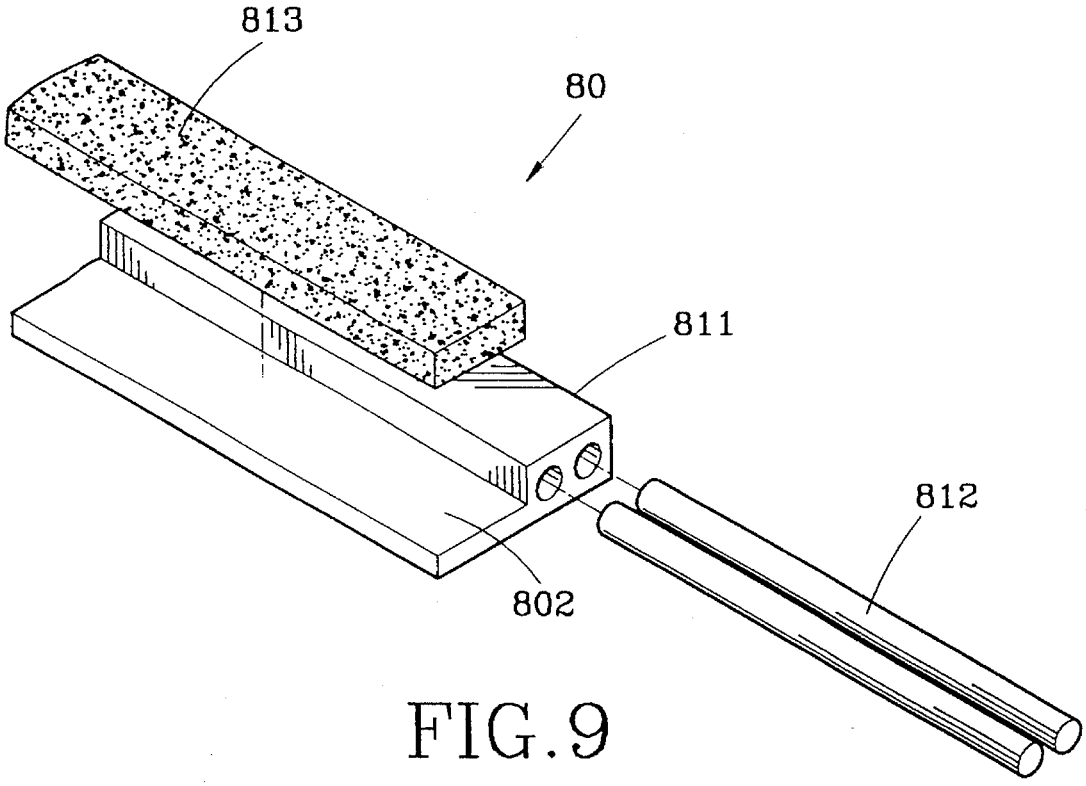
FIG. 9: An exploded view of the drainage strip of the drainage network pertaining to Practical Example 2 of the present invention.
Figure 9A:
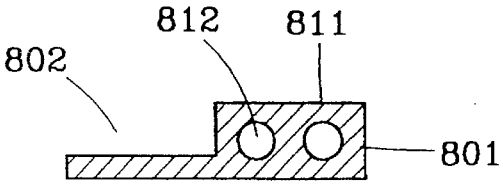
FIG. 9A: A cross-sectional view of the side-notched strip of the drainage strip shown in FIG. 9.

As shown in FIG. 8, the drainage network 8 pertaining to the present invention comprises a plurality of drainage strips 80 in a network configuration. As shown in FIG. 9, said drainage strip 80 includes a side-notched strip 811, one set of high tensile-strength polyester fiber bundles 812 and a drainage belt 813. A slot-containing strip 801 including one set of high tensile-strength polyester fiber bundles 812 is embedded in said side-notched strip 811 shown in FIG. 9-1. The strip 801 is formed by molding using a molding device in which the set of high tensile-strength polyester fiber bundles 812 is embedded in a polyethylene material. To one side of said slot-containing strip 801 lies a slot 802. A drainage belt 813 is inserted directly into said slot 802 in said slot-containing strip 801, thereby forming said drainage strip 80.

The drainage networks described in Practical Examples 1 and 2 provide identical results and differ only slightly in the shape and configuration of the drainage strip. The drainage belt employed in the present drainage networks is a porous material that allows water to freely permeate. The belt when the drainage network equipped with said drainage belt is set in the ground, rain water and underground water are diverted and drained away quickly, thereby alleviating hydraulic pressure exerted on the ground, increasing ground stability and preventing earth movements from occurring in the construction site.

The present drainage network in which the drainage belt is inserted into the drainage strip thereof has other merits. Specifically, grounds equipped with the present drainage network will never have problems of rain water and underground water being accumulated. Additionally, the installation of traditional underground drainage pipes (e.g., French drainage pipe) can be avoided, thereby reducing construction costs.

The above practical examples are specific examples of the drainage network pertaining to the present invention. However, the present invention is not defined by these practical examples alone, but by the scope of the appended claims.

I claim:

1. A drainage network, comprising:

a plurality of drainage strips joined together to form said drainage network wherein each drainage strip includes;

a side-notched strip including means to receive a drainage belt, a slot-containing strip including at least one set of high tensile-strength fiber bundles embedded in a polymeric material, and at least one drainage belt installed on said side-notched strip.

2. The drainage network of claim 1 wherein:

said strip is formed of polyethylene.

3. The drainage network of claim 1:

the number of sets of high tensile-strength fiber bundles is two, said bundles being situated on each side of said slot to receive said drainage belt.

* * * * *